US006273103B1

(12) United States Patent
Enz et al.

(10) Patent No.: US 6,273,103 B1
(45) Date of Patent: Aug. 14, 2001

(54) PRINTHEAD FLUSH AND CLEANING SYSTEM AND METHOD

(75) Inventors: Richard T. Enz, Dayton; John N. Blum, Kettering; Dan C. Lyman, Cincinnati; John C. Loyd, Centerville; Robert J. Simon, Bellbrook, all of OH (US)

(73) Assignee: Scitex Digital Printing, Inc., Dayton, OH (US)

( * ) Notice: Subject to any disclaimer, the term of this patent is extended or adjusted under 35 U.S.C. 154(b) by 0 days.

(21) Appl. No.: 09/211,213

(22) Filed: Dec. 14, 1998

(51) Int. Cl.[7] ..... B08B 9/03; B05B 7/16; B41J 2/165; B41J 2/02; B41J 2/085

(52) U.S. Cl. ..... 134/22.11; 118/302; 347/28; 347/36; 347/73; 347/76

(58) Field of Search ..... 347/28, 36, 73, 347/76; 118/302; 134/22.11

(56) References Cited

U.S. PATENT DOCUMENTS 4,296,418 * 10/1981 Yamazaki et al. ..... 346/75
4,528,996 * 7/1985 Jones ..... 134/104
4,542,389 * 9/1985 Allen ..... 346/140 R
4,623,897 * 11/1986 Brown et al. ..... 346/75
4,928,114 * 5/1990 Fagerquist et al. ..... 346/75

* cited by examiner

*Primary Examiner*—Randy Gulakowski
*Assistant Examiner*—Yolanda Wilkins
(74) *Attorney, Agent, or Firm*—Barbara Joan Haushalter

(57) ABSTRACT

A system and method are provided for cleaning the printhead of a continuous ink jet printing system. A cleaning fluid is introduced and used to flush ink residues and debris from the interior of the drop generator, the exterior of the orifice plate, the charge plate face and the catcher face. This system and method removes dried ink residues and other debris and deposits by providing a cleaning fluid with a low surface tension to dissolve or flush away the unwanted material from the orifices. This is particularly advantageous in that the flushing and rinsing is accomplished without mechanical contact which could abrade or damage the orifices.

7 Claims, 2 Drawing Sheets

PRINTHEAD FLUSH AND CLEANING SYSTEM AND METHOD

TECHNICAL FIELD

The present invention relates to continuous ink-jet printing and, more particularly, to the cleaning of printhead orifices and charging leads.

BACKGROUND ART

Continuous ink jet printheads utilize a series of orifices separated from charging leads by a small gap. Fluid is forced through the orifice while the printhead is in operation. Upon shutdown, the ink floods the leads and the area around the orifices. This fluid then dries, leaving behind non-volatile components in the form of solids or gels. Depending on the ink chemistry, this ink may polymerize as it dries, rendering it insoluble. Upon subsequent startups, the failure to remove or redissolve all of this material in the orifice and gap creates disturbances in the shape or direction of the emerging jet. Heavy deposits may block the orifice altogether. Deposits left on the charging leads may leave films which impair the proper charging of the drops as they form, causing insufficient deflection of the drop.

Current ink jet systems consist of a fluid module with a removable printhead. In the course of operation it may become necessary to move a printhead from one system to another. Ink residue remaining in the printhead from the previous system may contaminate the second system if the ink color or chemistry is incompatible.

This problem has been addressed in the prior art. For example, U.S. Pat. No. 5,706,039 distributes a cleaning fluid externally, in the plane of the orifices, not through them. This requires the use of a two layer construction, or forming internal passages within the orifice plate. The vacuum used to remove cleaning fluid in the vicinity of the orifice may also carry external debris into the orifices. U.S. Pat. Nos. 5,570,117 and 5,555,461 utilize wipers to remove ink from the orifices, with no additional cleaning fluid used. U.S. Pat. No. 5,557,307 uses a cleaning thread to wipe the orifices. Ink is adsorbed onto the thread, removing it before it dries.

Unfortunately, mechanical devices such as wipers and thread need replacement or maintenance from time to time and may serve to push particles into the orifices. It is seen, then, that there is a need for a system and/or method for cleaning a printhead which will avoid the problems associated with the prior art.

SUMMARY OF THE INVENTION

This need is met by the printhead flush and cleaning system and method according to the present invention. In accordance with the present invention, there is provided a means for cleaning a printhead which avoids the formation of deposits. The present invention removes dried deposits by providing a cleaning fluid with a low surface tension to dissolve or flush material away from the orifices, all without mechanical contact which could abrade or damage the orifices.

In accordance with one aspect of the present invention, a system and method are provided for cleaning the printhead of a continuous ink jet printing system. A cleaning fluid is introduced and used to flush ink residues and debris from the interior of the drop generator, the exterior of the orifice plate, the charge plate face and the catcher face. This system and method removes dried ink residues and other debris and deposits by providing a cleaning fluid with a low surface tension to dissolve or flush away the unwanted material from the orifices.

Other objects and advantage of the present invention will be apparent from the following description and the appended claims.

DETAILED DESCRIPTION OF THE INVENTION

In accordance with the present invention, the fluid system may be configured with one or more printheads. A common cleaning system serves multiple printheads in the multi-headed configuration. Since the separate plumbing within each printhead interface controller (PIC) and printhead is identical, the following description will make reference only to a single printhead, without restricting the invention to a single printhead.

Figure 1:
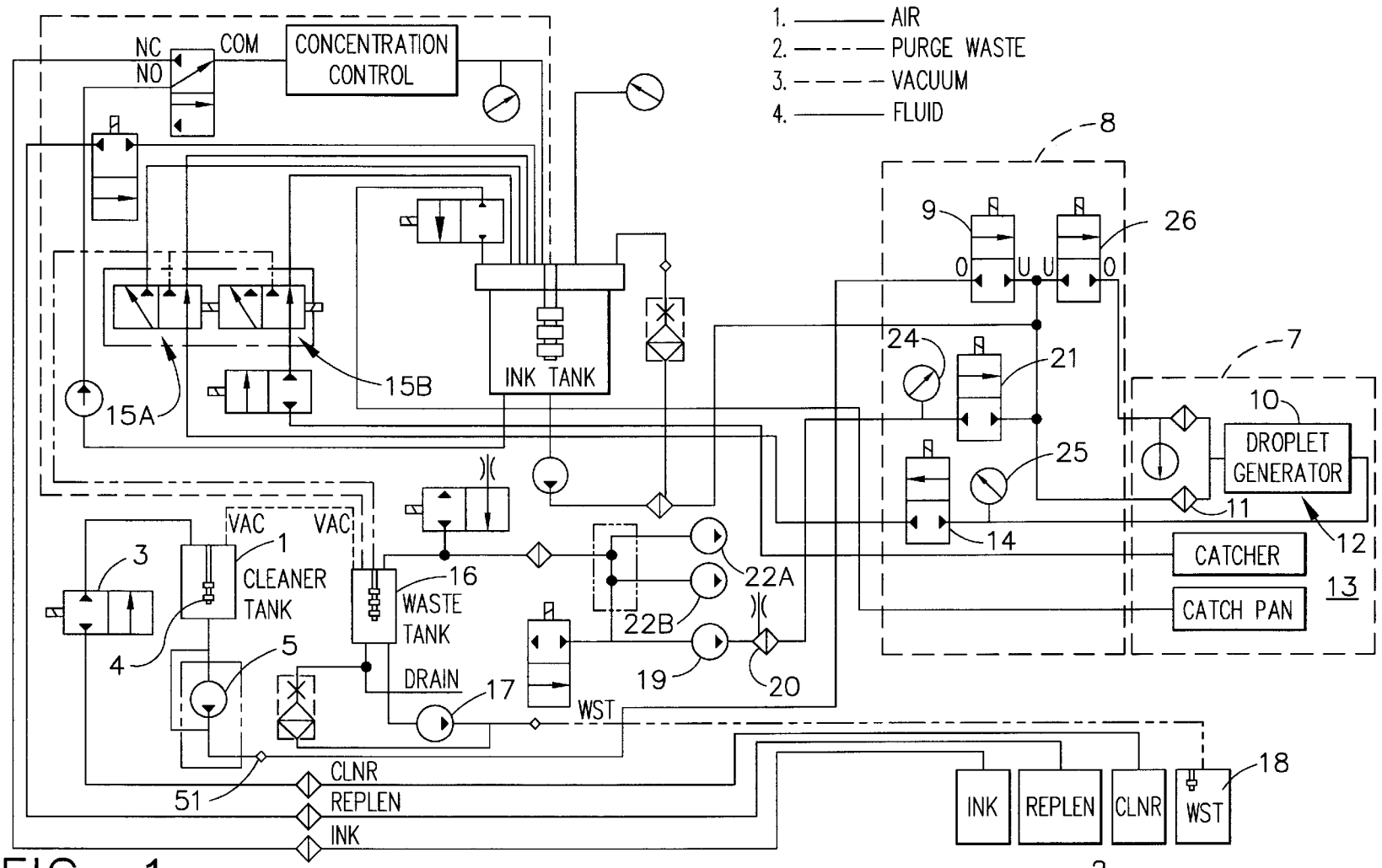
FIG. 1 is a schematic diagram of a continuous ink jet printer fluid system, illustrating printhead interface controllers and printheads.

Referring to FIG. 1, a preferred embodiment of the invention comprises a cleaning fluid supply tank 1, fed by an external source 2. Fill valve 3 is solenoid actuated, controlled by a float switch 4, maintaining the cleaning fluid level within the supply tank. The air above the supply tank is maintained at a partial vacuum of 10–18 in Hg, providing a pressure gradient for flow.

A pump 5, with integral manifold 6, moves the fluid to the printhead 7 via the PIC manifold 8. The same pump supplies cleaner to multiple printheads in a multiple printhead system, splitting the flow within the pump manifold. Check valve 51 prevents reverse flow through the pump, as the supply tank 1 is under vacuum. A solenoid actuated purge valve 9 allows the cleaning fluid into the droplet generator 10, through a filter 11, for example, a 1.2 micron filter. With vacuum supplied to the drop generator through the open outlet valve 14, the cleaning fluid flushes the ink residue from the interior of the drop generator.

Closing the outlet valve 14 causes the cleaning fluid to flow through the orifices 12. The cleaning fluid then rinses the ink residues from the face of the charge plate and the catcher 13, as the catcher is under vacuum, pulling the cleaning fluid with ink residue back to the fluid system. In this way the exterior of the drop generator and the face of the charge plate and catcher can be cleaned. Opening the ink filter purge valve 26 allows the cleaning fluid to flush the ink filter. In this way, problems associated with ink drying in the final filter can be eliminated.

In a preferred embodiment of the present invention, the cleaning fluid comprises a dyeless fluid having low surface tension. Since it is important not to contaminate clean ink with the waste mixture of cleaning fluid and residue, the waste is ported by a pair of 3-way waste valves 15*a* and 15*b*, to a separate internal waste tank 16. The waste is then pumped, as the tank fills, by waste pump 17 to external waste tank 18.

After the interior of the drop generator and exterior of the orifices and the face of the charge plate and catcher are rinsed with cleaning fluid, air pump 19 is activated to dry the interior of the droplet generator. The air passes through filter 20, such as a 70 micron filter, and a solenoid air valve 21. The air leaves the drop generator through the open bar outlet valve, and is exhausted through vacuum pumps 22*a* and 22*b*. To sense proper operation of the flushing system, pressure switch 24 and pressure transducer 25 are used to determine air and purge pressures.

Figure 2:
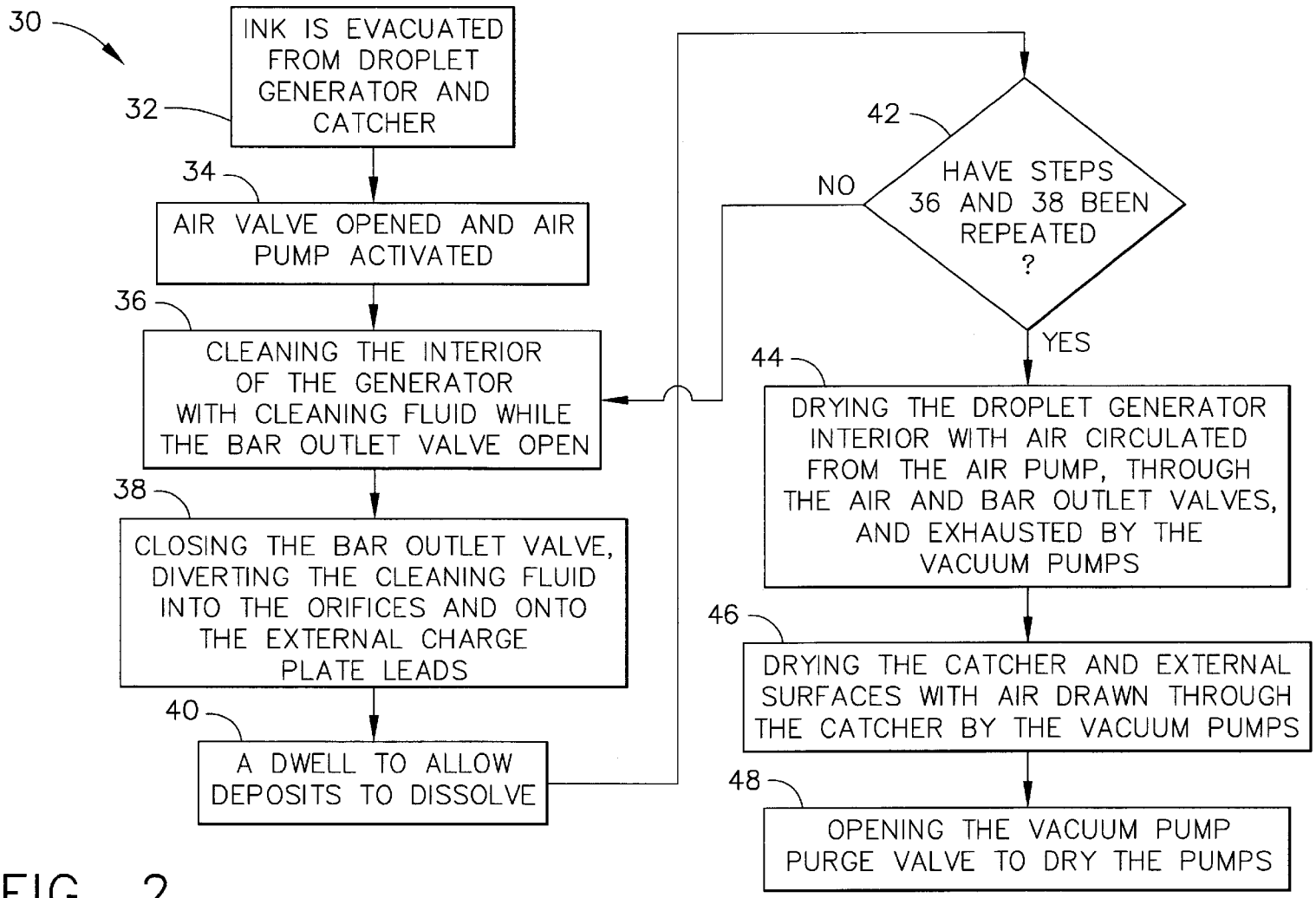
FIG. 2 is a flow chart diagram illustrating a shutdown sequence, in accordance with the present invention.

A preferred embodiment of the shutdown sequence for the present invention comprises the steps illustrated in flow chart 30 of FIG. 2. First, at step 32, ink is evacuated from the droplet generator and catcher. The air valve is then opened and the air pump actuated, at step 34, providing pressure to blow residual ink out of the air filter. This step conserves ink that would otherwise be diverted to waste as the drop generator is flushed.

Continuing with FIG. 2, cleaning of the interior of the droplet generator with cleaning fluid occurs at step 36, with the bar outlet valve open. Closing of the bar outlet valve occurs at step 38, diverting the cleaning fluid through the orifices and onto the charge plate leads and catcher face. Step 40 provides for a dwell time to allow deposits to dissolve, before repeating steps 36 and 38. Alternatively, a longer flush cycle could be used to completely dissolve deposits. The use of a dwell time reduces the amount of flush fluid required for cleaning. After steps 36 and 38 have been repeated, as determined at decision block 42, the flow chart proceeds to step 44 where the droplet generator interior is dried with air circulated from the air pump, through the air and bar outlet valves, and exhausted by the vacuum pumps. At step 46, the catcher and external surfaces are dried with air drawn through the catcher by the vacuum pumps.

An additional enhancement to the cleaning process may be the use of the drop generator stimulation to provide additional energy to remove debris. This ultrasonic stimulation is provided by the piezoelectric crystals used in normal droplet generator operation. This may be used in any of the flushing states or in the dwell state.

Additionally, the cleaning states in combination with the waste valves may be used to clean the printhead ink filter and other printhead components for changing of ink colors or removing a printhead, wherein the mixed ink and flush fluid is diverted to waste. This is performed by opening the ink filter purge valve 26 while performing steps 32 through 44 of the shutdown sequence. Steps 32 and 34 remove the bulk of the ink from both filters. Cleaning fluid is diverted into both the ink and air filters, in states 36 and 38, removing residual ink trapped in the filter pores. A low surface tension fluid aids in the wetting of the filter, allowing dilution of the ink and its removal. Both filters are then dried together.

There are times in which it is desirable to employ a partial cleaning cycle rather than the complete cycle described here. One example is a printhead shutdown/restart intended to clear a crooked jet or a print defect. In such an instance, it may be desirable to rinse the face of the charge plate. As the printhead will be restarted immediately after the clean cycle there is no need to dry out the printhead. In such an instance, the cleaning cycle might include only the steps 34 through 38. After completion of step 38, the printhead might be restarted in its normal sequence.

The implementation of the cleaning system may be incorporated into a fluid system as described above, or the components may be part of an additional stand alone module. An installation of more than one fluid system may share a common external cleaning fluid supply tank and waste tank.

Industrial Applicability and Advantages

The present invention is useful in the flushing and cleaning and shutdown of printheads in an ink jet printing system. The system of the present invention, which cleans the orifices and charge leads of a printhead, has the particular advantage of allowing printheads to be moved within and among systems, even if ink color and chemistry are incompatible.

The invention has been described in detail with particular reference to certain preferred embodiments thereof, but it will be understood that modifications and variations can be effected within the spirit and scope of the invention.

What is claimed is:

1. An apparatus for cleaning ink residues and debris of printing ink from a printhead of a continuous ink jet printing system having a drop generator with associated orifice plate, charge plate face and catcher face, the apparatus comprising:

a cleaning liquid separate from the printing ink;

means for applying the cleaning liquid to flush ink residues and debris from an interior of the drop generator;

means for applying the cleaning liquid to flush ink residues and debris from an exterior of the orifice plate;

means for applying the cleaning liquid to flush ink residues and debris from the charge plate face and catcher face.

2. An apparatus as claimed in claim 1 wherein the means for applying the cleaning liquid to flush ink residues and debris from an interior of the drop generator and from an exterior of the orifice plate occur concurrently.

3. An apparatus as claimed in claim 1 further comprising the means for applying the cleaning liquid to flush a final ink filter.

4. An apparatus as claimed in claim 1 wherein the cleaning liquid comprises a dyeless liquid having low surface tension.

5. An apparatus as claimed in claim 1 further comprising means for substantially drying the interior of the drop generator.

6. An apparatus as claimed in claim 1 wherein the cleaning liquid comprises cleaning liquid supplied under pressure to the drop generator.

7. An apparatus as claimed in claim 1 further comprising a waste receptacle for receiving spent cleaning liquid.

* * * * *